US006748862B2

(12) United States Patent
Frankenberger et al.

(10) Patent No.: US 6,748,862 B2
(45) Date of Patent: Jun. 15, 2004

(54) DEVICE FOR ADJUSTING AT LEAST ONE REGISTER ELEMENT IN A PRINTING MACHINE, AND CORRESPONDING METHOD

(75) Inventors: Eckart Frankenberger, Darmstadt (DE); Ludwig Becker, Reilingen (DE); Werner Weber, Sandhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 101 days.

(21) Appl. No.: 09/939,997

(22) Filed: Aug. 27, 2001

(65) Prior Publication Data

US 2002/0023563 A1 Feb. 28, 2002

(30) Foreign Application Priority Data

Aug. 25, 2000 (DE) ..... 100 41 908

(51) Int. Cl.[7] ..... B41F 27/00

(52) U.S. Cl. ..... 101/382.1; 101/415.1; 101/378; 101/409

(58) Field of Search ..... 101/415.1, 378, 101/382.1, 409

(56) References Cited

U.S. PATENT DOCUMENTS

| | | | | | |
|---|---|---|---|---|---|
| 3,634,819 | A | * | 1/1972 | Evans | 439/825 |
| 3,858,512 | A | * | 1/1975 | Simeth | 101/415.1 |
| 3,899,972 | A | * | 8/1975 | Albright | 101/415.1 |
| 4,489,653 | A | * | 12/1984 | Cappel et al. | 101/415.1 |
| 4,724,762 | A | * | 2/1988 | Jeschke et al. | 101/415.1 |
| 5,331,892 | A | * | 7/1994 | Seib et al. | 101/477 |
| 5,370,051 | A | * | 12/1994 | Schild et al. | 101/415.1 |
| 5,415,096 | A | * | 5/1995 | Koch et al. | 101/415.1 |
| 5,497,703 | A | * | 3/1996 | Becker | 101/415.1 |
| RE35,647 | E | * | 11/1997 | Simeth | 101/378 |
| 5,806,431 | A | * | 9/1998 | Muth | 101/486 |

FOREIGN PATENT DOCUMENTS

| | | |
|---|---|---|
| DE | 1 231 259 | 12/1966 |
| DE | 22 13 614 | 3/1973 |
| DE | 2 213 614 | 3/1973 |
| DE | 41 40 022 C2 | 6/1993 |
| DE | 42 23 908 C2 | 1/1994 |
| EP | 0 492 138 A1 | 7/1992 |
| EP | 0 596 337 A1 | 5/1994 |
| EP | 0 600 231 A1 | 6/1994 |
| GB | 1 431 815 | 3/1973 |
| GB | 2 261 848 B | 6/1993 |

* cited by examiner

*Primary Examiner*—Andrew H. Hirshfeld
*Assistant Examiner*—Andrea H. Evans
(74) *Attorney, Agent, or Firm*—Laurence A. Greenberg; Werner H. Stemer; Gregory L. Mayback

(57) ABSTRACT

The clamping device is used to adjust at least one register element in a printing machine. The device has an upper clamping rail, to which the register element is fixed. The upper clamping rail can be moved in a guide and fixed in position in order to adjust the register element.

15 Claims, 4 Drawing Sheets

DEVICE FOR ADJUSTING AT LEAST ONE REGISTER ELEMENT IN A PRINTING MACHINE, AND CORRESPONDING METHOD

BACKGROUND OF THE INVENTION

Field of the Invention

The invention lies in the printing technology field. More specifically, the invention relates to a device for adjusting at least one register element in a printing machine, having an upper clamping rail, to which the register elements are fixed, and a clamping element which co-operates with the upper clamping rail. The invention further pertains to a corresponding method.

In addition, the invention relates to a method of adjusting at least one register element in a printing machine.

Devices and methods which can be implemented therewith of the type addressed here are known from European patent EP 0 596 337 B1. There, the clamping rail, in particular of a sheet-fed offset printing machine, is used to fix a printing plate to an associated plate cylinder. Because of tolerances which become established and are not desired in the printing machine and therefore also on the plate cylinder, it is necessary to provide a positional adjustment of the register elements (register pins) in relation to a fixed printing-plate leading edge. European patent EP 0 596 337 B1 discloses the practice of adjusting the position of the register elements in each case in relation to the clamping rail by means of an appropriately designed fixing mechanism. In this way, unavoidable inaccuracies or play on the plate cylinder of the printing machine, between the clamping rail and the printing plate to be fixed, are compensated for, so that a printing plate to be clamped can be fixed to the plate cylinder in a precise and correct manner by means of the register elements operatively connected to the clamping rail.

It is additionally known, in order to adjust the position of register elements, to adjust the position of the entire clamping rail—comprising an upper clamping rail and a lower clamping strip co-operating with the latter—released from the plate cylinder together with the register elements. Since the clamping rail is operatively connected to the plate cylinder by means of a relatively large number of clamping means (clamping screws), loosening these clamping means for the subsequent positional adjustment of the clamping rail with register elements is disadvantageously time-consuming and complicated.

SUMMARY OF THE INVENTION

It is accordingly an object of the invention to provide a device adjusting at least one register element in a printing machine and a corresponding method, which overcomes the above-mentioned disadvantages of the heretofore-known devices and methods of this general type and which permits precise and rapid positional adjustment of the register elements, without having to loosen the operative connection between the register elements and the upper clamping rail for this purpose.

With the foregoing and other objects in view there is provided, in accordance with the invention, a device for adjusting a register element in a printing machine. The device comprises:

an upper clamping rail and a register element fixed to the upper clamping rail, wherein the upper clamping rail is movably disposed in a guide and fixable in position for adjusting the register element; and a clamping element co-operating with the upper clamping rail.

In other words, the above objects are achieved with a device the other clamping rail of which can be moved in a guide and fixed in position in order to adjust the register element. In this case, the guide is preferably designed in such a way that, in every possible operating position of the clamping rail, it can compensate for the blocking forces which are established in order to fix a printing plate to the plate cylinder. The adjustment of the respective register element is therefore carried out by means of a suitable relative movement of the upper clamping rail relative to the plate cylinder, the corresponding register element being fixed in a stable position even during the adjustment operation on the upper clamping rail. By means of an upper clamping rail which is always guided during the adjustment operation, it is possible, by using an adjusting means which is suitably designed and operatively connected to the upper clamping rail, to achieve rapid and defined adjustment of the register element. At the same time, it is not necessary to detach the upper clamping rail completely from the plate cylinder in order to adjust the register element, instead, because of the guidance provided for the clamping rail, there is also the possibility to deform or to bend the latter elastically in an adjustment direction by means of a suitable adjusting means in order to achieve a positioning of the respective register element, which is established appropriately, relative to the printing plate to be fixed or to be clamped to the plate cylinder. After assuming a desired operating position of the elastically deformed clamping rail or of the associated register element, the clamping rail can be fixed in position on the plate cylinder by means of suitable clamping or tensioning means. In accordance with an added feature of the invention, the guide is advantageously a sliding guide, and the position of the upper clamping rail can be adjusted by means of an adjusting device in a sliding direction corresponding to the adjustment direction of the register element. A sliding guide can be implemented relatively simply in production terms and is particularly suitable to compensate for forces which are established in order to fix a printing plate to the plate cylinder and are radial in relation to the plate cylinder, precise guidance of the upper clamping rail on the plate cylinder being ensured at the same time. This makes it possible, by means of a defined positional adjustment of the clamping rail, while actuating a suitably designed adjusting device, to obtain rapid and correct adjustment of the respective register element.

According to a preferred embodiment, the adjusting device has at least one mechanical adjusting element for producing an adjusting force acting on the upper clamping rail. In this case, the mechanical adjusting element provided can be a setting screw suitably operatively connected to the upper clamping rail, a wedge, an eccentric pin or the like, by means of which adjustment of the upper clamping rail in tangential direction with regard to the plate cylinder can be achieved. A mechanical adjusting element of this type is preferably operated manually.

According to a further alternative embodiment, the adjusting device has at least one electrical adjusting element for producing an adjusting force acting on the clamping rail. In this case, for example, the use of bundled piezoelectric actuators can be provided, by means of which an electrically triggerable introduction of force into the upper clamping rail in order to adjust the position of the same can be implemented. In this case, electrically operated adjusting elements are particularly suitable for the automated adjustment of the respective register element by means of a suitable, preferably central, control unit.

Clamping or tensioning means are advantageously provided to fix the position of the clamping rail. Clamping or tensioning means of this type, serving to lock or fix the deformed clamping rail, or the clamping rail displaced without elastic bending, can be designed as clamping screws, for example. In addition, it is possible to implement the positional fixing of the clamping rail by means of electrically operated clamping or tensioning means, so that automated fixing of the position of the clamping rail by means of a preferably central control unit is also possible.

The device is advantageously operatively connected to a central control unit. By means of a central control unit, by using electrically operated adjusting elements and positional fixing means for the clamping rail, automated and controlled adjustment of the respective register element can be carried out.

According to a further, alternative embodiment, the clamping rail comprises a multiplicity of relatively mobile part segments, each of which contains at least one register element. This makes it possible to adjust the positions of relatively guided part segments of the upper clamping rail independently of one another, preferably counter to an elastic restoring force, for example resulting from elastic bending of the corresponding part segment. Particularly flexible and preferably automated adjustment of the respective register element can therefore be implemented by means of a controlled movement of the corresponding part segment.

With the above and other objects in view there is also provided, in accordance with the invention, a method of adjusting at least one register element in a printing machine, which comprises providing an upper clamping rail having fixed thereto the register element, and moving the upper clamping rail in a guide and fixing the clamping rail in position in order to adjust the register element.

In other words, the objects are achieved with a method of adjusting at least one register element in a printing machine in which an upper clamping rail, to which the register element is fixed, is moved in a guide and fixed in position in order to adjust said register element. This method according to the invention is suitable to achieve the advantages previously mentioned with reference to the device.

The position of the clamping rail is preferably adjusted in a sliding guide by means of an adjusting device in the adjustment direction of the register element. The position of an upper clamping rail guided in a sliding guide can be adjusted precisely in a particularly reliable manner and is therefore suitable for finely set register element adjustment.

According to a preferred design variant, the adjusting force acting on the clamping rail is produced mechanically. This can be carried out, for example, by means of a manual adjustment of appropriately designed adjusting elements.

According to a further alternative design variant, the adjusting force acting on the upper clamping rail is produced electrically. The adjusting elements used for this purpose can be controlled, in a relatively simple way, by means of a central control unit, so that the adjustment of a respective register element can advantageously be automated.

The upper clamping rail is preferably fixed in position at a point and, at adjustment regions, wherein the register element is arranged and is guided in the adjustment direction, is deformed elastically and firmly clamped in a stable position. In this case, it is not necessary to loosen the point positional fixing of the upper clamping rail to the plate cylinder of the printing machine by means of elastic deformation in one or more adjustment regions in order to achieve a defined positional adjustment of the upper clamping rail, so that rapid and precise adjustment of the register element can be implemented.

Moving and fixing the position of the upper clamping rail in the guide is preferably carried out in an automated manner, and in particular by means of a central control unit. In this case, any play which may be present between the upper clamping rail and a printing plate to be clamped firmly to the plate cylinder can be determined by means of suitably arranged measuring means (sensors) and transmitted to the central control unit, which initiates a corresponding, automated adjustment of the position of the upper clamping rail and therefore suitable positioning of the respective register element by means of electrically controllable adjusting elements.

Corresponding to an alternative design variant, the upper clamping rail comprises a multiplicity of part segments which have at least one register element and are moved and fixed in position independently of one another. In this way, particularly flexible adjustment of the register elements by means of preferably elastic and automated deformation of the part segments is made possible, the part segments and therefore also the corresponding register elements being adjustable independently of one another.

Other features which are considered as characteristic for the invention are set forth in the appended claims.

Although the invention is illustrated and described herein as embodied in a device for adjusting at least one register element in a printing machine, and corresponding method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
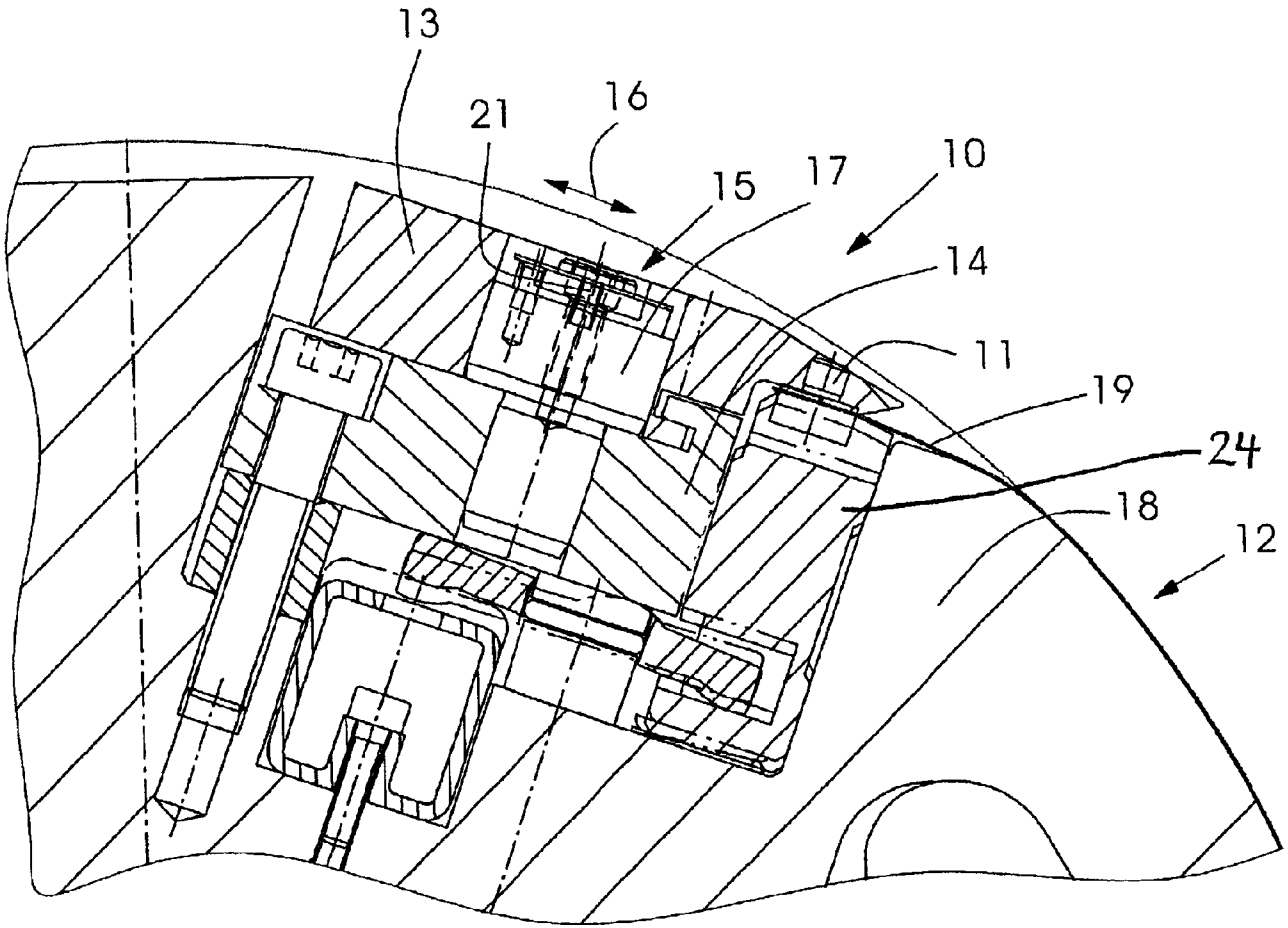
FIG. 1 is a schematic illustration of a cross section through a device according to the invention, corresponding to a first embodiment.

Referring now to the figures of the drawing in detail and first, particularly, to FIG. 1 thereof, there is seen a clamping device, designated generally by 10, for printing plates of a printing machine. The clamping device 10 is configured for the adjustment (fine setting) of at least one register element 11. The clamping device 10 is operatively connected to a plate cylinder 18, on which a printing plate 19 is aligned on register elements 11 (register pins). The printing plate 19 is fixed (braced) by means of the clamping device 10. The clamping device 10 has an upper clamping rail 13, to which the register elements 11 are securely fixed. For the purpose of clamping a printing plate, the upper clamping rail 13 cooperates with a clamping element 24 which can be moved in the radial direction with respect to the plate cylinder and, in order to adjust a respective register element 11, can be moved in a guide 14 and fixed in position. The guide 14 is designed as a sliding guide in the form of a flat guide and is suitable to compensate for forces (opposing forces to the printing plate bracing) which are radial with respect to the plate cylinder 18 and introduced into the guide 14 by means of the upper clamping rail 13. The clamping device 10 also contains an adjusting device 15, by means of which the position of the upper clamping rail 13 in the guide 14 can be adjusted in a sliding direction according to the double arrow 16. In this case, the sliding direction (double arrow 16) of the clamping rail 13 corresponds to the adjustment direction of a corresponding register element 11. The adjusting device 15 preferably has, according to FIG. 1, a multiplicity of mechanical adjusting elements 17, each of which is designed as manually operated eccentric bolts.

Figure 2:
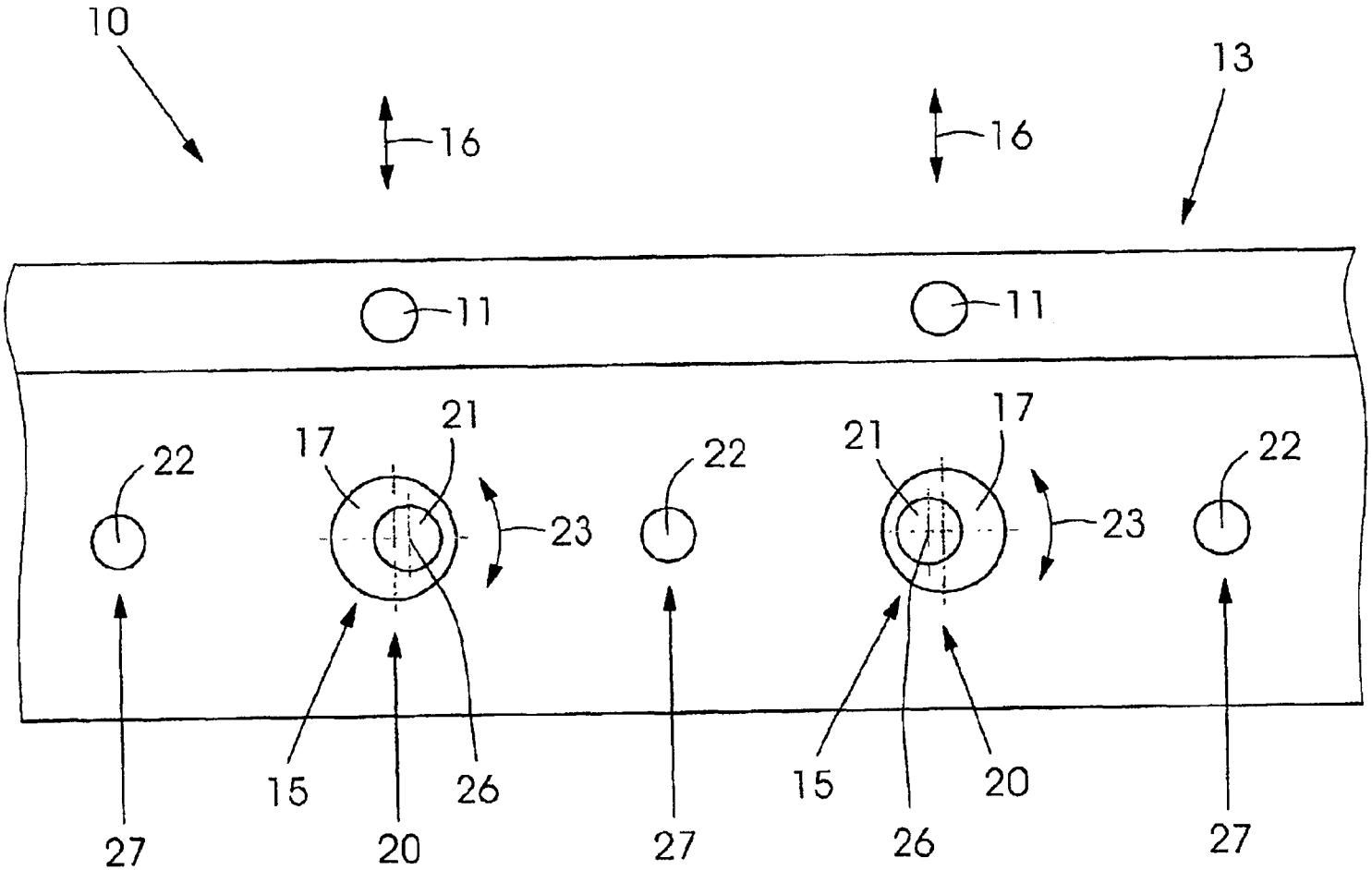
FIG. 2 is a plan view of the device of FIG. 1 in a schematic illustration.

FIG. 2 shows the clamping device 10 of FIG. 1 in a schematic plan view. Only the upper clamping rail 13 is illustrated. By means of suitable fixing means 22, for example in the form of clamping screws, the upper clamping rail 13 is permanently operatively connected at a point to the plate cylinder 18 (see also FIG. 1), not illustrated in FIG. 2, in a respective fixing area 27. By means of a rotation of the adjusting element 17 designed as an eccentric bolt in accordance with the double arrow 23 about an axis of rotation 26, it is possible to adjust the position of the clamping rail 13 elastically in a respective adjustment area 20 in the adjustment direction according to the double arrow 16, the upper clamping rail 13 always being guided in the guide 14, according to FIG. 1, over its entire length, that is to say in the transverse direction relative to the double arrow 16. By means of this controlled and elastically executed positional adjustment of the clamping rail 13 in the tangential direction with regard to the plate cylinder 18, the desired adjustment (positioning) of the corresponding register element 11 relative to the printing plate 19 is carried out (see also FIG. 1). After assuming the desired operating position of the upper clamping rail 13, and therefore also of the register elements 11, the corresponding adjusting element 17, designed as an eccentric bolt, is blocked by means of a suitable clamping or tensioning means 21, for example in the form of a clamping screw, in order to fix the clamping rail 13 completely in the operating position.

Figure 3:
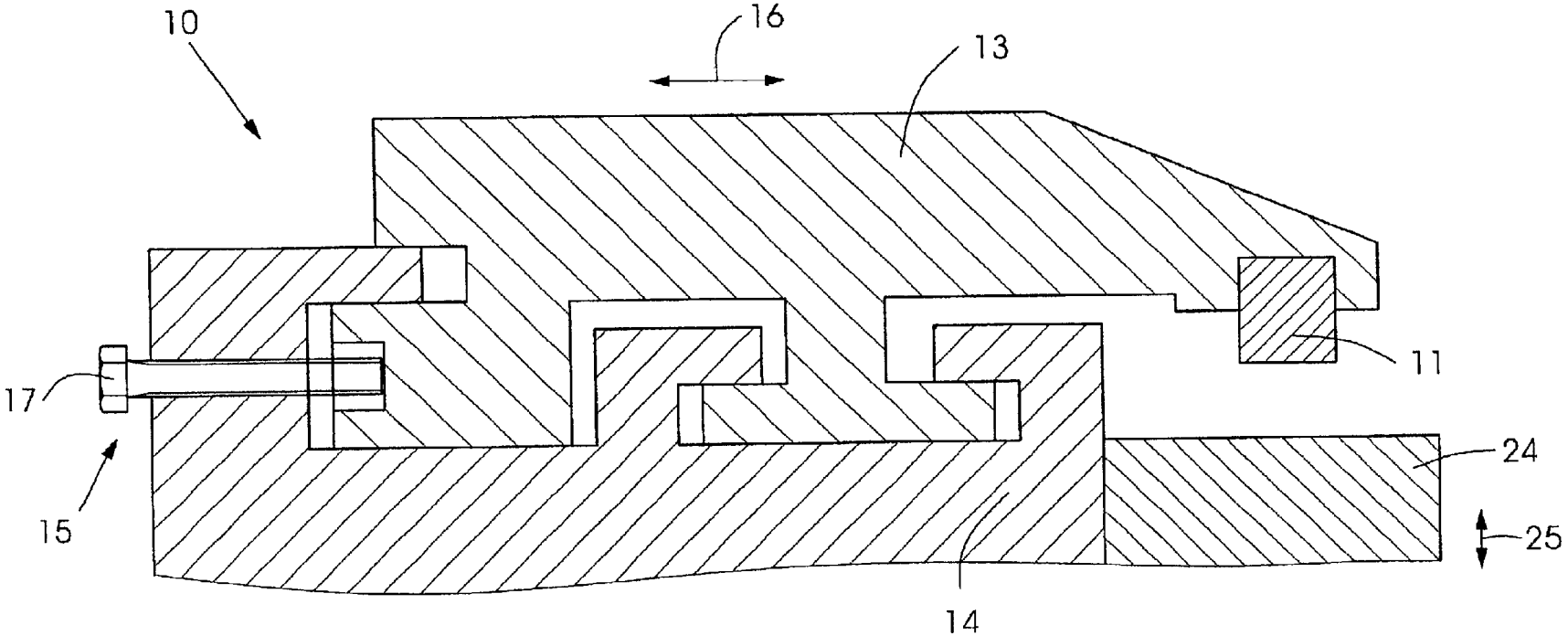
FIG. 3 is a schematic, cross-sectional view of a device according to the invention, in a second, alternative embodiment.

FIG. 3 shows an alternative embodiment of the clamping device 10 according to the invention, according to which the adjusting device 15 has an adjusting element 17 which is configured as a setting screw. When the setting screw 17 is operated, the position of the clamping rail 13 in the guide 14 is adjusted, either in accordance with the double arrow 16 (to the right in the drawing) counter to an elastic restoring force (intrinsic elasticity of the upper clamping rail 13), or moved back on account of this elastic restoring force acting (to the left in the drawing). In this way, the desired adjustment of the respective register element 11 is carried out in relation to a printing plate 19 which is not illustrated in FIG. 3 but which, by means of the upper clamping rail 13 and the clamping element 24, which can be moved in the radial direction with respect to the plate cylinder 19 according to the double arrow 25, can be fixed or clamped to the plate cylinder 18 at its leading edge in a known way.

Figure 4:
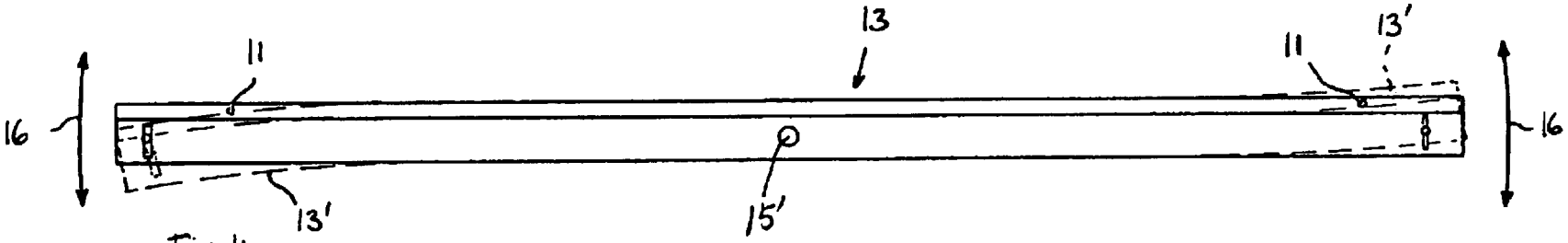
FIG. 4 is a schematic plan view of an alternative embodiment of the clamping bar.

In an alternative embodiment, schematically illustrated in FIG. 4, the upper clamping rail 13 can be fixed in position on the plate cylinder 18 (fixing region of the upper clamping rail 13) at its center by means of suitable fixing means 15' (for example a screw connection) and, at both its free longitudinal ends, deformed or bent elastically about its center in order to adjust register elements 11 spaced apart from one another in the longitudinal direction of the upper clamping rail 13 in the adjustment direction (double arrow 16) tangential with respect to the plate cylinder 18. In this case, the two free longitudinal ends of the upper clamping rail 13 can be displaceably mounted, for example by means of a dovetail guide extending along a corresponding circular path. The elastic displacement position of the clamping rail is illustrated at an exaggerated deflection position 13'.

Figure 5:
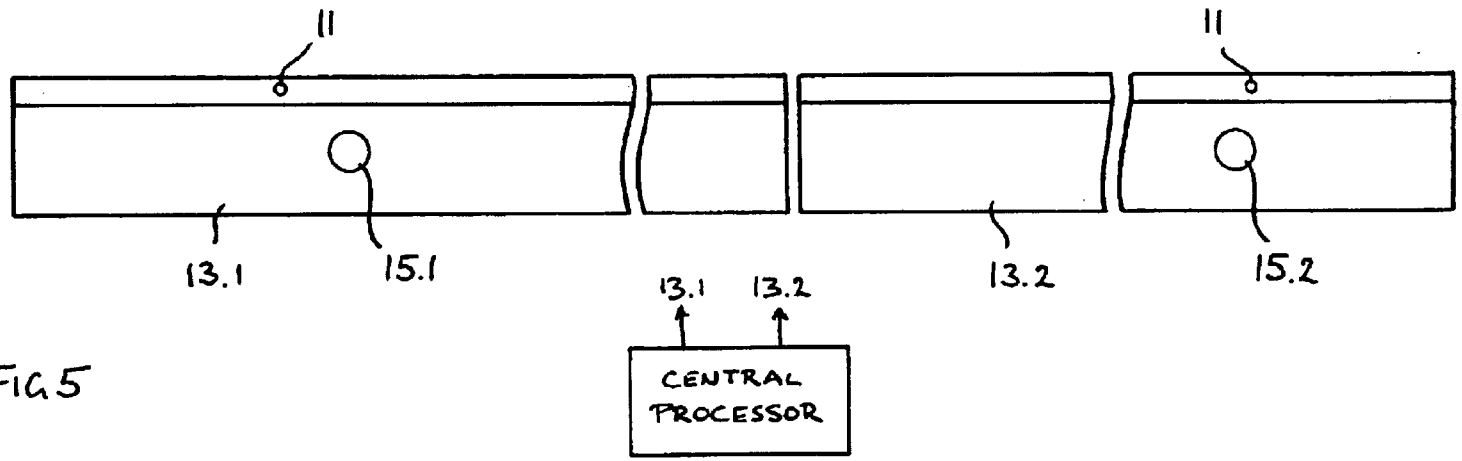
FIG. 5 is a schematic plan view of a further alternative embodiment of the invention.

In yet a further alternative embodiment of the device according to the invention, illustrated schematically in FIG. 5, the upper clamping rail 13 can also comprise two or more part segments 13.1, 13.2 which are separate and can be moved relative to one another. Each of the segments has at least one register element 11. In this case, each part segment is operatively connected to the plate cylinder 18 by means of an appropriate guide 15.1 and 15.2, respectively.

The adjusting elements 17 are preferably configured as electrically operated piezoelectric elements, actuators or the like, which can be in operative connection with a central control unit—diagrammatically illustrated only in FIG. 5—for the purpose of automated adjustment of the register elements 11. In the case of this embodiment, there is the option of adjusting a plate trailing edge tensioning means in an automated way in accordance with a register to be compensated for. In this case, a deviation of a register cross can be converted directly by a central control unit into a corresponding adjustment travel of the front and trailing edge of the printing plate 19, which can then be set exactly in an automated manner by means of the piezoelectric elements (piezoelectric actuators) on the upper clamping rail 13 and at the plate trailing edge. After the clamping rail 13 above the printing plate 19 has been fixed in the operating position, the printing plate 19 can be clamped firmly at its leading edge on the plate cylinder 18 by means of a radial movement of the clamping element 24 in accordance with the double arrow 25 (upward in the drawing).

In addition, it is alternatively possible for the upper clamping rail 13, instead of being deformed elastically, to be moved counter to an elastic restoring force of a spring element belonging to the clamping device 10.

We claim:

1. A device for adjusting a register element in a plate cylinder in a printing machine, comprising:

a guide;

an upper clamping rail and a register element fixed to said upper clamping rail, said upper clamping rail movably disposed in said guide and fixable in position for adjusting said register element; and a clamping element co-operating with said upper clamping rail, said upper clamping rail being movable relative to said clamping element in a peripheral direction of the elate cylinder.

2. The device according to claim 1, wherein said guide is a sliding guide, and the position of said upper clamping rail is adjustable with an adjusting device in a sliding direction corresponding to an adjustment direction of said register element.

3. The device according to claim 1, which comprises an adjusting device including at least one mechanical adjusting element for generating an adjusting force acting on said upper clamping rail.

4. The device according to claim 1, which comprises an adjusting device having at least one electrical adjusting element for generating an adjusting force acting on said upper clamping rail.

5. The device according to claim 1, which comprises clamping means for fixing the position of said upper clamping rail.

6. The device according to claim 1, which comprises tensioning means for fixing the position of said upper clamping rail.

7. The device according to claim 1, which comprises a central control unit operatively connected to said upper clamping rail.

8. The device according to claim 1, wherein said upper clamping rail is formed of a plurality of part segments movable disposed relative to one another and each containing at least one register element.

9. A method of adjusting at least one register element in a plate cylinder in a printing machine, which comprises providing an upper clamping rail having fixed thereto the register element, and moving the upper clamping rail in a guide relative to a co-operating clamping element in a peripheral direction of the plate cylinder and fixing the upper clamping rail in position in order to adjust the register element.

10. The method according to claim 9, which comprises adjusting a position of the upper clamping rail in a sliding guide by way of an adjusting device in an adjustment direction of the register element.

11. The method according to claim 9, which comprises mechanically generating an adjusting force acting on the upper clamping rail.

12. The method according to claim 9, which comprises electrically generating an adjusting force acting on the upper clamping rail.

13. The method according to claim 9, which comprises fixing the upper clamping rail in position at a point and, at defined adjustment regions, wherein the register element is guided in an adjustment direction, elastically deforming and firmly clamping the upper clamping rail in a stable position.

14. The method according to claim 9, which comprises moving and positionally fixing the upper clamping rail in the guide in an automated manner.

15. The method according to claim 9, which comprises providing the upper clamping rail as a plurality of part segments each having at least one register element, and moving and fixing in position the part segments independently of one another.

* * * * *